US008133543B2

(12) United States Patent
Linhart et al.

(10) Patent No.: US 8,133,543 B2
(45) Date of Patent: Mar. 13, 2012

(54) METHOD FOR IMPROVING PRINTABILITY ON PAPER OR PAPER PRODUCTS WITH THE AID OF INK-JET PRINTING METHOD

(75) Inventors: Friedrich Linhart, Heidelberg (DE); Rudi Mulder, Voorthuisen (NL); Andreas Hopf, Dahn (DE); Klaus Bohlmann, Ludwigshafen (DE)

(73) Assignee: BASF Aktiengesellschaft, Ludwigshafen (DE)

( * ) Notice: Subject to any disclaimer, the term of this patent is extended or adjusted under 35 U.S.C. 154(b) by 438 days.

(21) Appl. No.: 10/554,286

(22) PCT Filed: Apr. 20, 2004

(86) PCT No.: PCT/EP2004/004159

§ 371 (c)(1),
(2), (4) Date: Oct. 25, 2005

(87) PCT Pub. No.: WO2004/096566

PCT Pub. Date: Nov. 11, 2004

(65) Prior Publication Data

US 2007/0014940 A1 Jan. 18, 2007

(30) Foreign Application Priority Data

Apr. 30, 2003 (DE) ..... 103 19 741

(51) Int. Cl.
*B05D 3/02* (2006.01)

(52) U.S. Cl. ..... 427/391; 427/393.4; 427/389.9; 427/385.5; 427/326

(58) Field of Classification Search ..... 162/168.1, 162/164.6; 427/326, 389.9, 385.5, 391, 393.4
See application file for complete search history.

(56) References Cited

U.S. PATENT DOCUMENTS

| | | | | |
|---|---|---|---|---|
| 5,281,307 | A * | 1/1994 | Smigo et al. | 162/164.3 |
| 5,798,173 | A * | 8/1998 | Momma et al. | 428/342 |
| 6,132,558 | A * | 10/2000 | Dyllick-Brenzinger et al. | 162/164.6 |
| 2004/0154764 | A1 * | 8/2004 | Blum et al. | 162/135 |
| 2004/0182533 | A1 | 9/2004 | Blum et al. | |

FOREIGN PATENT DOCUMENTS

| | | | |
|---|---|---|---|
| EP | 0 739 743 | | 10/1996 |
| EP | 0 838 489 | | 4/1998 |
| JP | 59-198188 | | 11/1984 |
| JP | 60-109894 | * | 6/1985 |
| JP | 62-174184 | | 7/1987 |
| WO | WO 03/016624 | * | 2/2003 |
| WO | 03/021041 | | 3/2003 |
| WO | 03/022593 | | 3/2003 |

OTHER PUBLICATIONS

Gemma Morea-Swift and Helen Jones: "The Use of Synthetic Silicas in Coated Media for Ink-Jet Printing", 2000 TAPPI Coating Conference and Trade Fair, pp. 317-328.

* cited by examiner

*Primary Examiner* — Marianne L Padgett
*Assistant Examiner* — Robert S Walters, Jr.
(74) *Attorney, Agent, or Firm* — Oblon, Spivak, McClelland, Maier & Neustadt, L.L.P.

(57) ABSTRACT

A process for improving the printability of paper and paper products by enhancing the water resistance of ink-jet printed images, wherein the process comprises treating the paper or paper products with aqueous solutions of cationic polymers comprising vinylamine units and having a charge density of at least 3 meq/g as the sole treatment composition in aqueous solution, wherein the sole treatment composition is applied in an amount from 0.05 to 5 g/m$^2$ to the surface of the paper or the surface of the paper product.

15 Claims, No Drawings

METHOD FOR IMPROVING PRINTABILITY ON PAPER OR PAPER PRODUCTS WITH THE AID OF INK-JET PRINTING METHOD

CROSS-REFERENCE TO RELATED APPLICATIONS

The present application is a 35 U.S.C. §371 National Stage patent application of International patent application PCT/EP04/004159, filed on Apr. 20, 2004, which claims priority to German patent application DE 10319741.9, filed on Apr. 30, 2003.

BACKGROUND OF THE INVENTION

1. Field of the Invention

The present invention relates to a process for improving the printability of paper and paper products when printing with the aid of the ink-jet printing method by treating the paper or the paper products with aqueous solutions of cationic polymers.

2. Discussion of the Background

Printing of papers, paper-like materials or textiles using digital printing methods is becoming increasingly important in the printing industry. These digital printing methods also include the ink-jet printing method.

In the classical printing methods, a printing plate treated with ink is pressed onto the paper. The printing inks are in most cases not dissolved in water but in an organic solvent, such as toluene. In contrast, in the ink-jet printing method, drops of an ink generally dissolved in water are sprayed onto the recording material from a nozzle according to the contours present on the copy. The user's requirements and the requirements of the ink-jet printing method with respect to the recording material, e.g. paper, are therefore of a very different kind compared with the classical printing methods. However, as in all other printing methods, the requirements with respect to the printed image and hence with respect to the paper used also vary very considerably in terms of quality, depending on the purpose for which the image is intended. For images which are to have the quality of a photograph, an appropriately high-quality paper must be used. For very simple messages and designs on paper which are not to be stored, papers of a quality which permit reading or recognition of the message or of the image are sufficient. Between these two extremes, there is a wide range of papers which have to meet the respective requirements for ink-jet printing. High-quality papers suitable for this printing method are provided, for example, with a coating of a water-absorptive pigment, a hydrophilic binder and a cationic polymer (cf. G. Morea-Swift, H. Jones, THE USE OF SYNTHETIC SILICAS IN COATED MEDIA FOR INK-JET PRINTING, in 2000 TAPPI Coating Conference and Trade Fair Proceedings, 317-328). For fairly undemanding ink-jet prints, natural papers having a simple starch coating are frequently used.

In contrast to most other printing methods, the ink-jet printing method has the basic disadvantage that the printouts are water-sensitive owing to the water solubility or the water dispersibility of the inks used. When the printed image comes into contact with water, this leads to running of the inks into one another and into the paper, both in the plane of the paper and perpendicular to the plane of the paper. In the most unfavorable case, a script is then no longer legible, an image is blurred and the inks strike through to the back of the paper. Of course, the water resistance of the printout is not of major importance for all users, but, even in the case of users whose images usually do not come into contact with water, it is very annoying if water accidentally drips onto the image and smudges it and if the ink which has run out soils the tablecloth, or the image shows the imprints of moist fingers. For papers which are printed on with the aid of the ink-jet printing method and which are exposed to rain, for example placard papers or packaging papers, or which may become moist through condensation or filling liquids, e.g. bottle labels, water resistance of the ink-jet printout is indispensable. If, for example, the bar code on a packaging or on a label is no longer crisp owing to the action of moisture and is not read or is incorrectly read, the economic damage may be very great. High-quality expensive papers for ink-jet printing, as used, for example, for photography, art printing, etc., give water-resistant printed images. They are produced by coating base paper with an ink consisting of a water-absorptive pigment, preferably silica, a water-soluble binder, preferably polyvinyl alcohol, if required further water-soluble binders, and cationic organic polymers (cf. G. Morea-Swift, H. Jones, THE USE OF SYNTHETIC SILICAS IN COATED MEDIA FOR INK-JET PRINTING, above).

WO-A-03/021041 discloses that the whiteness of recording materials can be increased if mixtures which comprise an optical brightener, a cationic polymer and a solvent are applied thereon. The recording materials thus obtainable can be printed on by the ink-jet method. They give substantially better color reproduction and crispness of contours than conventional papers.

For the large amount of relatively simple papers, e.g. office papers, such special coatings are too complicated, too expensive and frequently also unsuitable for conventional processing of the papers, for example for printing by the offset method, for copying, for simple writing on using ink or for drawing using a pencil and erasing of the drawing. The printing of daily newspapers from the Internet on an ink-jet printer is becoming more and more fashionable. For the abovementioned reasons, a simple paper which gives a water-resistant ink-jet printout is required for this purpose.

SUMMARY OF THE INVENTION

The present invention relates to a process for improving the printability of paper and paper products when printing with the aid of the ink-jet printing method by treating the paper or the paper products with aqueous solutions of cationic polymers.

It is an object of the present invention to improve the printability of paper and paper products which do not give sufficiently water-resistant ink-jet printed images.

DETAILED DESCRIPTION OF THE INVENTION

We have found that this object is achieved, according to the invention, by a process for improving the printability of paper and paper products when printing with the aid of the ink-jet printing method by treating the paper or the paper products with aqueous solutions of cationic polymers, if a cationic polymer having a charge density of at least 3 meq/g is used as the sole treatment composition in aqueous solution and is applied in an amount of from 0.05 to 5 g/m$^2$ to the surface of the paper or of the paper product.

It was surprising that the printed image obtained by means of an ink-jet printer can be made water-resistant by simple treatment of a paper with solutions of suitable organic polycations without further additives.

Suitable cationic polyelectrolytes are those which are usually used as process chemicals in papermaking, for example as fixing agents, as retention aids and drainage aids, as paper strength agents, as flocculants, etc. These include in particular polyethylenimine and its derivatives, polyamines, polyamidoamines, polyamidoamine-epichlorohydrin resins, polydiallyldimethylammonium chloride, other polydiallyidialkylammonium salts, polydiallylalkylammonium salts, polyallylamine, polyvinylamine, partly hydrolyzed polyvinylformamides, polymers and copolymers of dialkylaminoalkyl acrylates and methacrylates, polymers and copolymers of acryloylalkyltrialkylammonium salts and of methacryloylalkyltrialkylammonium salts, homopolymers and copolymers of dialkylaminoalkylacrylamides and dialkylaminoalkylmethacrylamides, polymers and copolymers of acrylamidoalkyltrialkylammonium salts and of methacrylamidoalkyltrialkylammonium salts, copolymers of diallyidimethylammonium chloride, copolymers of vinylformamide, polymers and copolymers of vinylimidazole, quaternized and/or substituted vinylimidazoles, polymers and copolymers of vinylpyridine. The abovementioned polymers are described in detail in WO-A-03/021041, page 9, line 16 to page 21, line 8, cited as part of the prior art.

Polymers from the group consisting of the polymers comprising vinylamine units, polymers comprising ethylenimine units, polymers comprising diallyldimethylammonium chloride units, polymers comprising quaternized dimethylaminoethyl(meth)acrylate units, polymers comprising dimethylaminoethyl(meth)acrylamide units, condensates which comprise ethylenediamine or diethylenetriamine in the form of condensed units and polyamidoamines crosslinked with epichlorohydrin are preferred.

Particularly preferably, hydrolyzed homo- or copolymers of N-vinylformamide having a degree of hydrolysis of from 20 to 100%, polyethylenimines, polydiallyldimethylammonium chlorides and/or polyamidoamine resins crosslinked with epichlorohydrin are suitable as cationic polymers.

According to the invention, said polyelectrolytes can be used both individually and in any combination with one another. If appropriate, they can also be mixed with nonionic water-soluble polymers.

The water resistance of the printed ink-jet images depends on various factors, for example on the inks used and on the paper which is treated with the polycations, and on the density of the positive charges on the polycations and on the molar mass of the polycations. Good water resistance can be observed with charge densities of at least 3 milliequivalents per gram (always referred to below as meq/g) of polycation (without taking into account the anions). However, the water resistance increases with the charge density so that charge densities above 3.5 to 23 meq/g of polycation are preferred. Charge densities of from 8 to about 20 meq/g of polycation are very particularly preferred. The molar mass of the polycations also has an effect on the water resistance. It is, for example, at least 10 000 Dalton, and the polymers should preferably be chosen so that the charge density is high at low molar masses. Molar masses of the polycations of more than 50 000 Dalton are preferred, those of more than 100 000 Dalton being particularly preferred.

The molar masses of the cationic polyelectrolytes which can be used according to the invention may be, for example, up to 5 million, preferably up to 2 million, Dalton. The viscosities of the aqueous solutions of the polyelectrolytes is established so that a sufficient amount of polymer can penetrate into the paper. The viscosities of the aqueous solutions of the cationic polymers should not be higher than 3 000 mPa·s, preferably not higher than 2 000 mPa·s. They are generally from 10 to 1 000 mPa·s, measured in each case at 20° C.

The novel treatment of the papers with the solutions of the cationic polyelectrolytes can be carried out by the methods customary for the surface treatment of paper in the paper industry. Known application units can be used for this purpose, for example film presses, size presses, various coating units having knife coaters, blades or air brushes, or spraying means, as described, for example, for the application of starch in EP-A-0 373 276 or for the application of coating slips by V. Nissinen, Wochenblatt für Papierfabrikation, 11/12 (2001), 794-806. The application of the aqueous solutions of the cationic polyelectrolytes can, however, also be effected during the calendering of paper via the damping units. What is important is that the cationic polyelectrolyte penetrates at least partly into the paper and does not only remain adhering to the surface of the paper.

The amount of cationic polyelectrolytes which is applied according to the invention to the paper can vary within wide limits. In general, it is from 0.05 to 5, preferably from 0.1 to 3, in particular from 0.5 to 2, g per $m^2$ of paper, based on the solvent-free cationic polyelectrolytes.

The present invention also relates to the use of aqueous solutions which comprise cationic polymers having a charge density of at least 3 meq/g as the sole treatment composition for application to the surface of paper or paper products in an amount of from 0.05 to 5 g of cationic polymer per $m^2$ for improving the ink-jet printability of paper and paper products.

According to the invention, the printability of all recording materials, such as graphic arts papers, natural paper or coated paper, and of paper products, such as cardboard and board, can be improved by applying aqueous solutions of the cationic polyelectrolytes to the surface of the papers or paper products. The aqueous solutions of cationic polymers can be applied once or several times, for example from once to three times, preferably once or twice. In general, a single application is sufficient. Application can be effected only on one side or on both sides (front and back) of the paper. The aqueous solutions of the cationic polymers can also be applied simultaneously to the top and the bottom of the paper.

When the aqueous solution of the cationic polymers is applied several times, this can be carried out, for example, in each case on the top surface of the paper or of the paper products or, for example in the case of coated paper, on the back, for example once on the base paper, once before and once after the final coat, or once after the preliminary coat, once after the middle coat and once after the final coat, or once before and once after the final coat.

The solution of the polyelectrolyte is preferably applied to a natural paper or to a coated paper after the final coat, particularly preferably once or twice, very particularly preferably once. The aqueous solution of the cationic polymers can be applied to the paper or the paper products, for example with the aid of a size press, a film press, a spraying means, a coating unit or paper calender.

After the application of the aqueous polyelectrolyte solutions to the paper or the paper products, the products are preferably dried in order to remove the water and if necessary calendered. The drying of the treated papers is effected, for example, by means of drying cylinders, infrared lamps, hot air, etc. The calendering of the treated paper is generally carried out at from 15 to 100° C.

The papers, boards or cardboards treated according to the invention can be printed on by means of the variants of the ink-jet printing method with the aid of the respective printing units. However, they can also be printed on by conventional methods, for example offset, letterpress or gravure printing methods, flexographic printing methods or other digital printing methods, e.g. laser printing methods or indigo printing methods. In these printing methods, too, water-resistant printed images are obtained.

The novel process makes it easier for a person skilled in the art to achieve the difficult object of producing, with very simple means and high flexibility, papers which give water-resistant printed images on printing by various ink-jet methods and can also be printed on by classical printing methods and other digital printing methods and may have further advantageous properties.

EXAMPLES

In the examples which follow, percentages are by weight. The charge density of the cationic polymers was determined with the aid of colloid titration, cf. D. Horn, Progr. Colloid & Polymer Sci. 65 (1978), 251-264.

The water sensitivity of printed images obtained by an ink-jet printing method was displayed in particular in the case of multicolor printouts. For assessing black/white ink-jet printed images, there are quantitative measuring methods by means of which the wicking is assessed, i.e. the running of the ink into the unprinted paper. The same measuring method is occasionally also used for assessing the bleeding. This is understood as meaning the running of two inks into one another. In the case of multicolor printed images, the running of black into a yellow-printed area is measured.

In developing the novel process, however, it was found that, in many, but not all, ink-jet printers, black is relatively water-resistant and also exhibits relatively little bleeding into a yellow-printed area, whereas the colors blue, magenta and yellow run to such an extent into adjacent unprinted areas or areas of a different color that a quantitative measuring method is not up to the task. In the examples below, the water resistance was therefore assessed qualitatively on the basis of the running of the colors blue, magenta and yellow into an unprinted area and into one another by subjective ratings of 1 for very water-resistant to 5 for very poorly water-resistant. In the case of coated papers, the running of colors was rated in the same way, the decrease in the color intensity and the decrease in the crispness of contour as quality of the printed image with the ratings 1 for very water-resistant to 5 for very poorly water-resistant.

In a similar manner, the wicking onto a filter paper placed underneath was assessed with the ratings 1 for no wicking to 5 for strong wicking. In some cases, strike-through of the inks to the back of the paper after treatment with water was also rated with the ratings ink-jet 1 to 3.

Cationic Organic Polyelectrolytes Used:

Polyelectrolyte I: Commercial polydiallyldimethylammonium chloride (CATIOFAST® CS from BASF Aktiengesellschaft). The charge density of the polycation measured at pH 4.5 was 7.9 meq/g.

Polyelectrolyte II: Polyamidoamine obtained from adipic acid and diethylenetriamine, which was grafted with ethylenimine and crosslinked with polyethylene glycol dichlorohydrin ether having 34 ethylene oxide units, cf. example 3 of German Patent 2,434,816. The charge density of the polycation measured at pH 4.5 was 10.2 meq/g.

Polyelectrolyte III: Commercial polyamidoamine-epichlorohydrin resin (LURESIN® KNU from BASF Aktiengesellschaft). The charge density of the polycation measured at pH 4.5 was 3.5 meq/g.

Polyelectrolyte IV (comparison): Polyvinylformamide having a molar mass of about 300 000 Dalton, from which 10% of the formyl groups had been eliminated with formation of amino groups. The charge density of the polycation measured at pH 4.5 was 1.5 meq/g.

Polyelectrolyte V: Polyvinylformamide having a molar mass of about 300 000 Dalton, from which 30% of the formyl groups had been eliminated with formation of amino groups. The charge density of the polycation measured at pH 4.5 was 4.8 meq/g.

Polyelectrolyte VI: Polyvinylformamide having a molar mass of about 300 000 Dalton, from which 50% of the formyl groups had been eliminated. The charge density of the polycation measured at pH 4.5 was 8.8 meq/g.

Polyelectrolyte VII: Polyvinylformamide having a molar mass of about 300 000 Dalton, in which 75% of the formyl groups had been eliminated with formation of amino groups. The charge density of the polycation measured at pH 4.5 was 14.4 meq/g.

Polyelectrolyte VIII: Polyvinylformamide having a molar mass of about 300 000 Dalton, from which 90% of the formyl groups had been eliminated with formation of amino groups. The charge density of the polycation measured at pH 4.5 was 19.7 meq/g.

Polyelectrolyte IX: Polyvinylformamide having a molar mass of about 30 000 Dalton, from which 90% of the formyl groups had been eliminated with formation of amino groups. The charge density of the polycation measured at pH 4.5 was 20.4 meq/g.

Polyelectrolyte X: High molecular weight polyethylenimine, crosslinked with a polyethylene glycol dichlorohydrin ether and neutralized with formic acid (CATIOFAST® SF from BASF Aktiengesellschaft). The charge density of the polycation measured at pH 4.5 was 19.0 meq/g.

Polyelectrolyte XI: Polyvinylformamide having a molar mass of about 45 000 Dalton, from which 23% of the formyl groups had been eliminated with formation of amino groups. The charge density of the polycation measured at pH 4.5 was 3.6 meq/g.

Polyelectrolyte XII: High molecular weight polyethylenimine, neutralized with formic acid (CATIOFAST® PL from BASF Aktiengesellschaft). The charge density of the polycation measured at pH 4.5 was 19.8 meq/g.

Example 1

Sheets of an industrially produced paper which was used as a basis for coated paper, having a basis weight of 68 g/m$^2$, were treated with aqueous solutions of various polyelectrolytes in a laboratory size press. The concentrations of polyelectrolyte in the size press liquors and the amount of solvent-free polyelectrolyte applied to the paper are shown in table 1.

After drying, the papers were printed with a printed image which comprised black, white and colored script and areas by means of the ink-jet printers likewise shown in table 1. Relatively small strips which in turn comprised black, white and colored script and areas were cut out of the printed papers in the same parts in each case. These strips, two different ones per image, were kept in a vessel containing tap water for 30 seconds, said strips being gently agitated for 10 seconds. Thereafter, they were placed on a blotting paper comprising white untreated cellulose and left to dry. The bleeding of the colors and the wicking onto the blotting paper were assessed as described above with the ratings 1 to 5. The results are listed in table 1.

TABLE 1

| | | Polyelectrolyte | | | | | | | | | |
|---|---|---|---|---|---|---|---|---|---|---|---|
| | | | I | II | III | IV (Comparison) | V | VI | VII | VIII | IX |
| Concentration of polyelectrolyte in the size press liquor | % | — | 10.0 | 9.1 | 10.0 | 6.3 | 6.3 | 5.3 | 5.8 | 5.0 | 10.0 |
| Viscosity of the size press liquor | mPa · s | — | 30 | 94 | 60 | 80 | 84 | 88 | 82 | 70 | 14 |
| Application of polyelectrolyte (solid) to the paper | $g/m^2$ | 0 | 2.3 | 2.0 | 2.2 | 1.6 | 1.6 | 1.4 | 1.5 | 1.2 | 1.5 |
| Assessment of the water resistance of the print Printer: Epson Stylus Color 980 | | | | | | | | | | | |
| 1st strip | | | | | | | | | | | |
| Bleeding | Rating | 5 | 3 | 2 | 3 | 4 | 1 | 1 | 2 | 3 | 3 |
| Wicking onto filter paper | Rating | 5 | 5 | 4 | 3 | 4 | 1 | 1 | 2 | 3 | 3 |
| 2nd strip | | | | | | | | | | | |
| Bleeding | Rating | 5 | 4 | 1 | 3 | 2 | 1 | 1 | 3 | 3 | 2 |
| Wicking onto filter paper | Rating | 5 | 5 | 3 | 2 | 4 | 2 | 1 | 2 | 2 | 3 |
| Printer: Hewlett Packard 895 Cxi | | | | | | | | | | | |
| 1st strip | | | | | | | | | | | |
| Bleeding | Rating | 5 | 2 | 1 | 2 | 3 | 1 | 1 | 1 | 1 | 1 |
| Wicking onto filter paper | Rating | 5 | 5 | 2 | 1 | 4 | 1 | | 1 | 1 | 3 |
| 2nd strip | | | | | | | | | | | |
| Bleeding | Rating | 5 | 2 | 1 | 2 | 4 | 1 | 1 | 1 | 1 | 1 |
| Wicking onto filter paper | Rating | 5 | 4 | 1 | 1 | 3 | 1 | 1 | 1 | 1 | 2 |

Example 2

10 percent strength aqueous solutions of cationic polyelectrolytes were applied by means of a manual knife coater to a paper which had been provided with 10 g/m2 of a coating which corresponded to the prior art and consisted of 100 parts of calcium carbonate, 6 parts of starch, 16 parts of a 50% strength polymer dispersion (STYRONAL® D 610 from BASF Aktiengesellschaft) and smaller amounts of assistants, so that, after drying, 1.0 g/m2 of the polyelectrolyte remained on the paper. The paper was dried and calendered according to the prior art. Thereafter, the papers were printed by means of the ink-jet printer shown in table 2 with a printed image which comprised black, white and colored script and areas. Relatively small strips which in turn comprised black, white and colored script and areas were cut out of the printed papers in the same parts in each case. These strips were kept in a vessel containing tap water for 30 seconds, said strips being gently agitated for 10 seconds. They were then placed on a blotting paper comprising white untreated cellulose and left to dry. The quality of the printed image and the strike-through of the inks to the back of the paper after the treatment with water were rated as described above with the ratings 1 to 5 and 1 to 3, respectively. The results are listed in table 2.

TABLE 2

| | | Polyelectrolyte | | |
|---|---|---|---|---|
| | | | I | X |
| Concentration of polyelectrolyte in the solution | % | — | 10.0 | 10.0 |
| Viscosity of the solution | mPa · s | — | 35 | 105 |
| Application of polyelectrolyte (solid) to the paper | $g/m^2$ | 0 | 1 | 1 |

TABLE 2-continued

| | | Polyelectrolyte | | |
|---|---|---|---|---|
| | | | I | X |
| Assessment of the water resistance of the print | | | | |
| Printer: Hewlett Packard 895 Cxi | | | | |
| Quality of the printed image | Rating | 5 | 3 | 1 |
| Strike-through to back | Rating | 3 | 2 | 1 |

Example 3

The respective 10 percent strength aqueous solutions of cationic polyelectrolytes shown in table 3 were applied by means of a manual knife coater to a paper which had been provided with 10 g/m2 of a coating which corresponded to the prior art and consisted of 100 parts of calcium carbonate, 6 parts of starch, 16 parts of a 50% strength polymer dispersion (STYRONAL® D 610 from BASF Aktiengesellschaft) and smaller amounts of assistants, so that, after drying, 1.0 g/m2 of the polyelectrolyte remained on the paper. The paper was dried and calendered according to the prior art. Thereafter, the papers were printed by means of the ink-jet printer shown in table 3 with a printed image which comprised black, white and colored script and areas. Relatively small strips which in turn comprised black, white and colored script and areas were cut out of the printed papers in the same parts in each case. These strips were kept in tap water for 30 seconds, said strips being gently agitated for 10 seconds. They were then placed on a blotting paper comprising white untreated cellulose and left to dry. The quality of the printed image and the strike-through of the inks to the back of the paper after the treatment with water were rated as described above with the ratings 1 to 5 and 1 to 3, respectively. The results are listed in table 3.

TABLE 3

| | | | Polyelectrolyte | | | | |
|---|---|---|---|---|---|---|---|
| | | | I | II | V | XI | XII |
| Concentration of polyelectrolyte in the solution | % | — | 10.0 | 10.0 | 10.0 | 10.0 | 10.0 |
| Viscosity of the solution | mPa · s | — | 28 | 55 | 1000 | 23 | 20 |
| Application of polyelectrolyte (solid) to the paper | $g/m^2$ | 0 | 1.0 | 1.0 | 1.0 | 1.0 | 1.0 |
| Assessment of the water resistance of the print Printer: Hewlett Packard 2000 C | | | | | | | |
| Quality of the printed image | Rating | 5 | 3 | 1 | 2 | 2 | 1 |
| Strike-through to back | Rating | 3 | 2 | 1 | 2 | 2 | 2 |

Example 4

10 percent strength aqueous solutions of the cationic polyelectrolytes shown in table 4 were applied by means of a manual knife coater to industrially produced paper having a basis weight of 68 $g/m^2$, which was used as the basis for a coated paper, so that, after drying, 2.0 $g/m^2$ of the polyelectrolyte remained on the paper. The paper was dried and calendered according to the prior art.

Thereafter, the papers were printed by means of the ink-jet printer shown in table 4 with a printed image which comprised black, white and colored script and areas. Relatively small strips which in turn comprised black, white and colored script and areas were cut out from the printed papers in the same parts in each case. These strips were kept in a vessel containing tap water for 30 seconds, said strips being gently agitated for 10 seconds. They were then placed on a blotting paper comprising white untreated cellulose and left to dry. The bleeding of the colors and the strike-through of the inks to the back of the paper after the treatment with water were rated with the ratings 1 to 5 and 1 to 3, respectively, as described above. The results are listed in table 4.

TABLE 4

| Polyelectrolyte | | | 1 | II | IV (Comparison) | V | XI |
|---|---|---|---|---|---|---|---|
| Concentration of polyelectrolyte in the solution | % | — | 10.0 | 10.0 | 10.0 | 10.0 | 10.0 |
| Viscosity of the solution | mPa · s | — | 28 | 55 | 1710 | 1000 | 23 |
| Application of polyelectrolyte (solid) to the paper | $g/m^2$ | 0 | 2 | 2 | 2 | 2 | 2 |
| Assessment of the water resistance of the print | | | | | | | |
| Printer: Hewlett Packard 2000 C | | | | | | | |
| Bleeding | Rating | 5 | 2 | 1 | 5 | 4 | 2 |
| Strike-through to back | Rating | 3 | 2 | 1 | 3 | 1 | 2 |

We claim:

1. A process for improving the printability of paper and a paper product by enhancing the water resistance of ink-jet printed images, wherein said process comprises treating the paper or the paper product with an aqueous solution comprising a cationic polymer, wherein the cationic polymer is a hydrolyzed homopolymer of N-vinylformamide having a degree of hydrolysis of 50-100% and comprises positive charge providing units, has a charge density of at least 3 meq/g and is used as the sole treatment composition in the aqueous solution, wherein said composition is applied in an amount of from 0.05 $g/m^2$ to 5 $g/m^2$ to the surface of the paper or the surface of the paper product, and wherein after the treatment with the cationic polymer the treated paper or paper product is not coated.

2. The process according to claim 1, wherein the charge density of the cationic polymer is from 3.5 meq/g to 23 meq/g.

3. The process according to claim 1, wherein the charge density of the cationic polymer is from 8 meq/g to 20 meq/g.

4. The process according to claim 1, wherein the cationic polymer has a molar mass $M_w$ of at least 10,000 Dalton.

5. The process according to claim 1, wherein the aqueous solution comprising the cationic polymer is applied to the paper or the paper product with the aid of a size press, a film press, a spraying means, a coating unit or a paper calender.

6. The process according to claim 1, wherein the cationic polymer has a molar mass $M_w$ of from 50,000 Dalton to 5,000,000 Dalton.

7. The process according to claim 1, wherein the cationic polymer has a molar mass $M_w$ of from 100,000 Dalton to 2,000,000 Dalton.

8. The process according to claim 1, wherein the aqueous solution comprising the cationic polymer has a viscosity of 3,000 mPa·s or less at 20° C.

9. The process according to claim 1, wherein the aqueous solution comprising the cationic polymer has a viscosity of 2,000 mPa·s or less at 20° C.

10. The process according to claim 1, wherein the aqueous solution comprising the cationic polymer has a viscosity of from 10 mPa·s to 1,000 mPa·s at 20° C.

11. The process according to claim 1, wherein the cationic polymer is applied to the paper in an amount of from 0.1 $g/m^2$ to 3 $g/m^2$.

12. The process according to claim 1, wherein the cationic polymer is applied to the paper in an amount of from 0.5 $g/m^2$ to 2 $g/m^2$.

13. The process according to claim 1, wherein the cationic polymer is a hydrolyzed homopolymer of N-vinylformamide having a degree of hydrolysis of 50-90%.

14. The process according to claim 1, wherein the cationic polymer is a hydrolyzed homopolymer of N-vinylformamide having a degree of hydrolysis of 75-90%.

15. The process according to claim 1, wherein the cationic polymer is a hydrolyzed homopolymer of N-vinylformamide having a degree of hydrolysis of 50-75%.

* * * * *